US008985215B2

(12) United States Patent
Tips et al.

(10) Patent No.: US 8,985,215 B2
(45) **Date of Patent: *Mar. 24, 2015**

(54) SINGLE TRIP MULTI-ZONE COMPLETION SYSTEMS AND METHODS

(71) Applicant: Halliburton Energy Services, Inc., Houston, TX (US)

(72) Inventors: Timothy R. Tips, Montgomery, TX (US); William Mark Richards, Flower Mound, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/313,448

(22) Filed: Jun. 24, 2014

(65) Prior Publication Data

US 2014/0305642 A1 Oct. 16, 2014

Related U.S. Application Data

(63) Continuation of application No. 13/896,887, filed on May 17, 2013, now Pat. No. 8,857,518, which is a continuation of application No. 13/988,139, filed as application No. PCT/US2012/057241 on Mar. 26, 2012, now Pat. No. 8,851,189.

(51) Int. Cl.
*E21B 34/14* (2006.01)
*E21B 43/14* (2006.01)
(Continued)

(52) U.S. Cl.
CPC ..... *E21B 43/25* (2013.01); *E21B 43/14* (2013.01); *E21B 34/06* (2013.01); *E21B 43/08* (2013.01)
USPC ..... 166/313; 166/369

(58) Field of Classification Search
USPC ..... 166/313, 369, 373, 386, 250.01
See application file for complete search history.

(56) References Cited

U.S. PATENT DOCUMENTS 4,615,388 A 10/1986 Walhaug et al.
4,628,995 A 12/1986 Young et al.
(Continued)

FOREIGN PATENT DOCUMENTS

WO 03/080993 A1 10/2003
WO 2005/045174 A2 5/2005
WO 2012/112657 A2 8/2012

OTHER PUBLICATIONS

Search Report and Written Opinion cited in International Application No. PCT/US2012/057220 dated Apr. 8, 2013.
(Continued)

*Primary Examiner* — David Andrews
(74) *Attorney, Agent, or Firm* — Scott Richardson; Baker Botts L.L.P.

(57) ABSTRACT

Disclosed are systems and methods of producing from multiple production zones with a single trip multi-zone completion system. One method includes arranging an outer completion string within a wellbore adjacent the one or more formation zones, the outer completion string having at least one sand screen arranged thereabout and a flow control device movably disposed within the sand screen, locating an insert string within the outer completion string, the insert string having at least one control and data acquisition module disposed thereon that has one or more mechanical coupling mechanisms, locating the flow control device with the one or more mechanical coupling mechanisms, and moving the flow control device between a closed position and an open position with the one or more mechanical coupling mechanisms.

11 Claims, 1 Drawing Sheet

(51) Int. Cl.

| | |
|---|---|
| ***E21B 43/25*** | (2006.01) |
| ***E21B 34/06*** | (2006.01) |
| ***E21B 43/08*** | (2006.01) |

(56) References Cited

U.S. PATENT DOCUMENTS

| | | | |
|---|---|---|---|
| 4,678,035 | A | 7/1987 | Goldschild |
| 4,806,928 | A | 2/1989 | Veneruso |
| 4,949,788 | A | 8/1990 | Szarka et al. |
| 5,547,029 | A | 8/1996 | Rubbo et al. |
| 5,921,318 | A | 7/1999 | Ross |
| 6,247,536 | B1 | 6/2001 | Leismer et al. |
| 6,253,857 | B1 | 7/2001 | Gano |
| 6,257,332 | B1 | 7/2001 | Vidrine et al. |
| 6,257,338 | B1 | 7/2001 | Kilgore |
| 6,446,729 | B1 | 9/2002 | Bixenman et al. |
| 6,523,609 | B1 | 2/2003 | Miszewski |
| 6,575,237 | B2 | 6/2003 | Purkis et al. |
| 6,629,564 | B1 | 10/2003 | Ramakrishnan et al. |
| 6,655,452 | B2 | 12/2003 | Zillinger |
| 6,684,951 | B2 | 2/2004 | Restarick et al. |
| 6,712,149 | B2 | 3/2004 | Leismer et al. |
| 6,983,796 | B2 | 1/2006 | Bayne et al. |
| 7,055,598 | B2 | 6/2006 | Ross et al. |
| 7,165,892 | B2 | 1/2007 | Grigsby et al. |
| 7,222,676 | B2 | 5/2007 | Patel et al. |
| 7,228,912 | B2 | 6/2007 | Patel et al. |
| 7,273,106 | B2 | 9/2007 | Huckabee et al. |
| 7,278,486 | B2 | 10/2007 | Alba et al. |
| 7,306,043 | B2 | 12/2007 | Toekje et al. |
| 7,377,321 | B2 | 5/2008 | Rytlewski |
| 7,428,932 | B1 | 9/2008 | Wintill et al. |
| 7,735,555 | B2 | 6/2010 | Patel et al. |
| 7,900,705 | B2 | 3/2011 | Patel |
| 7,950,454 | B2 | 5/2011 | Patel et al. |
| 7,950,461 | B2 | 5/2011 | Schrader et al. |
| 7,966,875 | B2 | 6/2011 | Proett et al. |
| 8,079,419 | B2 | 12/2011 | Richards |
| 8,082,998 | B2 | 12/2011 | Richards |
| 2003/0079878 | A1 | 5/2003 | Pramann et al. |
| 2003/0221829 | A1 | 12/2003 | Patel et al. |
| 2003/0226665 | A1 | 12/2003 | Jones et al. |
| 2004/0035591 | A1 | 2/2004 | Echols |
| 2004/0173363 | A1 | 9/2004 | Navarro-Sorroche |
| 2004/0262011 | A1 | 12/2004 | Huckabee et al. |
| 2006/0196660 | A1 | 9/2006 | Patel |
| 2007/0235185 | A1 | 10/2007 | Patel et al. |
| 2008/0257544 | A1 | 10/2008 | Thigpen et al. |
| 2009/0188665 | A1 | 7/2009 | Tubel et al. |
| 2009/0260835 | A1 | 10/2009 | Malone |
| 2009/0283272 | A1 | 11/2009 | Amaral et al. |
| 2009/0288824 | A1 | 11/2009 | Fowler, Jr. et al. |
| 2010/0038093 | A1 | 2/2010 | Patel |
| 2010/0139909 | A1 | 6/2010 | Tirado et al. |
| 2010/0175894 | A1 | 7/2010 | Debard et al. |
| 2010/0193182 | A1 | 8/2010 | Levy |
| 2010/0212963 | A1 | 8/2010 | Gopalan et al. |
| 2010/0243270 | A1 | 9/2010 | Ingram et al. |
| 2011/0011577 | A1 | 1/2011 | Dusterhoft et al. |
| 2011/0024105 | A1 | 2/2011 | Hammer et al. |
| 2011/0061862 | A1 | 3/2011 | Loretz et al. |
| 2011/0061875 | A1 | 3/2011 | Tips et al. |
| 2011/0108287 | A1 | 5/2011 | Richards |
| 2011/0120726 | A1 | 5/2011 | Murray et al. |
| 2011/0132601 | A1 | 6/2011 | Pettinato et al. |
| 2011/0209873 | A1 | 9/2011 | Stout |
| 2011/0214883 | A1 | 9/2011 | Patel |
| 2012/0024520 | A1 | 2/2012 | Fripp et al. |
| 2012/0181043 | A1 | 7/2012 | Patel |
| 2012/0181045 | A1 | 7/2012 | Thomas et al. |
| 2012/0199346 | A1 | 8/2012 | Patel et al. |
| 2012/0222860 | A1 | 9/2012 | Kalman et al. |
| 2012/0325484 | A1 | 12/2012 | Patel |

OTHER PUBLICATIONS

Search Report and Written Opinion cited in International Application No. PCT/US2012/057257 dated Apr. 23, 2013.

Search Report and Written Opinion cited in International Application No. PCT/US2012/057283 dated Apr. 23, 2013.

Search Report and Written Opinion cited in International Application No. PCT/US2012/057215 dated Apr. 25, 2013.

Search Report and Written Opinion cited in International Application No. PCT/US2012/057241 dated Apr. 29, 2013.

Halliburton Energy Services, Inc., "Sand Control Systems", H06382, company article dated Jul. 2009, 6 pages.

Search Report and Written Opinion cited in International Appl. No. PCT/US2012/057231 dated Apr. 23, 2013.

Halliburton Energy Services, Inc. "IV Series Interval Control Valves," H06972 dated Aug. 2009, 2 pages.

Halliburton Energy Services, Inc. "Scrams", H06976, Feb. 2012, 2 pages.

Halliburton Energy Services, Inc. "Long Space-Out Travel Joint (LSOTJ)," H08460, dated Dec. 2011, 2 pages.

Halliburton Brochure entitled "Sand Control Systems, Enhanced Single Trip Multizone (ESMTZ tm) System", H06382, 2009.

Mazerov, "GOM Completions: Innovation Filling in Technology Gaps at Nearly Six Miles Under," reprinted from the May/Jun. 2009 edition of Drilling Contractor Magazine.

Specification and Drawings for U.S. Appl. No. 13/913,111, filed Jun. 7, 2013, 47 pages.

Specification and Drawings for U.S. Appl. No. 13/950,674, filed Jul. 25, 2013, 44 pages.

Office Action issued Oct. 4, 2013 in U.S. Appl. No. 13/913,111, 23 pages.

Office Action issued Oct. 4, 2013 in U.S. Appl. No. 13/918,077, 15 pages.

Office Action issued Dec. 20, 2013 for U.S. Appl. No. 13/950,674, 22 pages.

Office Action issued Feb. 10, 2014 for U.S. Appl. No. 13/913,111, 21 pages.

Specification and Drawings for PCT Patent App. No. PCT/US12/57266, filed Sep. 26, 2012, 42 pages.

Specification and Drawings for PCT Patent App. No. PCT/US12/57271, filed Sep. 26, 2012, 40 pages.

Specification and Drawings for PCT Patent App. No. PCT/US12/57278, filed Sep. 26, 2012, 42 pages.

Specification and Drawings filed Jul. 10, 2013 for U.S. Appl. No. 13/939,163, 60 pages.

Specification and Drawings filed Jul. 10, 2013 for U.S. Appl. No. 13/979,137, 42 pages.

Specification and Drawings filed Sep. 5, 2013 for U.S. Appl. No. 14/003,451, 52 pages.

Search Report and Written Opinion cited in International Appl. No. PCT/US2012/057271 dated Apr. 26, 2013.

Search Report and Written Opinion cited in International Appl. No. PCT/US2012/057278 dated May 8, 2013.

Office Action issued Apr. 15, 2014 in U.S. Appl. No. 13/913,111, 22 pages.

Office Action issued Apr. 10, 2014 in U.S. Appl. No. 13/918,077, 26 pages.

Office Action issued Mar. 12, 2014 in U.S. Appl. No. 13/950,674, 14 pages.

Office Action issued May 28, 2014 in U.S. Appl. No. 13/894,830, 24 pages.

Office Action issued Apr. 30, 2014 in U.S. Appl. No. 13/988,139, 14 pages.

Office Action issued Apr. 2, 2014 in U.S. Appl. No. 13/896,887, 7 pages.

Office Action issued May 6, 2014 in U.S. Appl. No. 13/988,099, 17 pages.

Office Action issued Jun. 19, 2014 in U.S. Appl. No. 13/979,137, 10 pages.

SINGLE TRIP MULTI-ZONE COMPLETION SYSTEMS AND METHODS

CROSS-REFERENCE TO RELATED APPLICATIONS

This application is a continuation of U.S. patent application Ser. No. 13/896,887 filed on May 17, 2013, which is a continuation of U.S. patent application Ser. No. 13/988,139 filed on May 17, 2013, which claims priority to and is a National Stage entry of International App. No. PCT/US2012/057241 filed on Sep. 26, 2012.

BACKGROUND

The present invention relates to the treatment of subterranean production intervals and, more particularly, to gravel packing, fracturing, and production of multiple production intervals with a single trip multi-zone completion system.

In the production of oil and gas, recently drilled deep wells reach as much as 31,000 feet or more below the ground or subsea surface. Offshore wells may be drilled in water exhibiting depths of as much as 10,000 feet or more. The total depth from an offshore platform to the bottom of a drilled wellbore can be as much as eight miles. Such extraordinary distances in modern well construction cause significant challenges in equipment, drilling, and servicing operations.

For example, tubular strings can be introduced into a well in a variety of different ways. It may take many days for a wellbore service string to make a "trip" into a wellbore, which may be due in part to the time consuming practice of making and breaking pipe joints to reach the desired depth. Moreover, the time required to assemble and deploy any service tool assembly downhole for such a long distance is very time consuming and costly. Since the cost per hour to operate a drilling or production rig is very expensive, saving time and steps can be hugely beneficial in terms of cost-savings in well service operations. Each trip into the wellbore adds expense and increases the possibility that tools may become lost in the wellbore, thereby requiring still further operations for their retrieval. Moreover, each additional trip into the wellbore oftentimes has the effect of reducing the inner diameter of the wellbore, which restricts the size of tools that are able to be introduced into the wellbore past such points.

To enable the fracturing and/or gravel packing of multiple hydrocarbon-producing zones in reduced timelines, some oil service providers have developed "single trip" multi-zone systems. The single trip multi-zone completion technology enables operators to perforate a large wellbore interval at one time, then make a clean-out trip and run all of the screens and packers at one time, thereby minimizing the number of trips into the wellbore and rig days required to complete conventional fracture and gravel packing operations in multiple pay zones. It is estimated that such technology can save in the realm of $20 million per well. Since rig costs are so high in the deepwater environment, more efficient and economical means of carrying out single trip multi-zone completion operations is an ongoing effort.

SUMMARY OF THE INVENTION

The present invention relates to the treatment of subterranean production intervals and, more particularly, to gravel packing, fracturing, and production of multiple production intervals with a single trip multi-zone completion system.

In some embodiments of the disclosure, a single trip multi-zone completion system is disclosed. The system may include an outer completion string having at least one sand screen arranged thereabout and a flow control device movably disposed within the at least one sand screen between an open position and a closed position, and an insert string arranged within the outer completion string and having at least one control and data acquisition module disposed thereon having one or more coupling mechanisms and configured to locate and move the flow control device.

In other embodiments of the disclosure, a single trip multi-zone completion system for producing from one or more formation zones is disclosed. The system may include an outer completion string having at least one sand screen arranged thereabout adjacent the one or more formation zones, a flow control device disposed within the at least one sand screen and movable between an open position and a closed position, wherein, when in the open position, fluids may communicate from the one or more formation zones, through the at least one sand screen, and into the outer completion string, an insert string arranged within the outer completion string and being communicably coupled to the outer completion string at a crossover coupling, the crossover coupling having one or more control lines coupled thereto, and at least one control and data acquisition module disposed on the insert string and having one or more mechanical coupling mechanisms.

In yet other embodiments of the disclosure, a method of producing from one or more formation zones is disclosed. The method may include arranging an outer completion string within a wellbore adjacent the one or more formation zones, the outer completion string having at least one sand screen arranged thereabout and a flow control device movably disposed within the at least one sand screen, locating an insert string within the outer completion string, the insert string having at least one control and data acquisition module disposed thereon having one or more mechanical coupling mechanisms extending therefrom, locating the flow control device, and moving the flow control device between a closed position and an open position, wherein, when in the open position, fluids may communicate from the one or more formation zones, through the at least one sand screen, and into the outer completion string.

In even further aspects of the disclosure, a method of deploying a single trip multi-zone completion system is disclosed. The method may include arranging an outer completion string within a wellbore that penetrates one or more formation zones, the outer completion string having at least one sand screen arranged thereabout and a flow control device movably disposed within the at least one sand screen, locating an inner service tool within the outer completion string, treating the one or more formation zones with the inner service tool, retrieving the inner service tool from within the outer completion string, locating an insert string within the outer completion string, the insert string having at least one control and data acquisition module arranged therein, and locating and moving the flow control device with the at least one control and data acquisition module and thereby regulating a fluid flow through the at least one sand screen.

The features and advantages of the present invention will be readily apparent to those skilled in the art upon a reading of the description of the preferred embodiments that follows.

BRIEF DESCRIPTION OF THE DRAWINGS

The following figures are included to illustrate certain aspects of the present invention, and should not be viewed as exclusive embodiments. The subject matter disclosed is capable of considerable modifications, alterations, combinations, and equivalents in form and function, as will occur to those skilled in the art and having the benefit of this disclosure.

DETAILED DESCRIPTION

The present invention relates to the treatment of subterranean production intervals and, more particularly, to gravel packing, fracturing, and production of multiple production intervals with a single trip multi-zone completion system.

The exemplary single trip multi-zone systems and methods disclosed herein allow multiple zones of a wellbore to be gravel packed and fractured in the same run-in trip into the wellbore. An exemplary insert string is subsequently extended into the wellbore in order to regulate and monitor production from each zone. Control lines located within the insert string and also along the sand face allow operators to monitor production operations, including measuring fluid and well environment parameters at each point within the system. The insert string may include one or more control and data acquisition modules that include mechanical coupling mechanisms used to locate and move corresponding flow control devices arranged within respective sand screens adjacent each zone. Adjusting the position of the flow control device with a corresponding control and data acquisition module serves to choke or otherwise regulate the production flow rate through the sand screen, thereby allowing for the intelligent production of hydrocarbons from each zone. In the event a control and data acquisition module fails or otherwise malfunctions, the insert string may be returned to the surface without requiring the removal of the remaining portions of the system. Once proper repairs or modifications have been completed, the insert string may once again be run into the wellbore to resume production.

Figure 1:
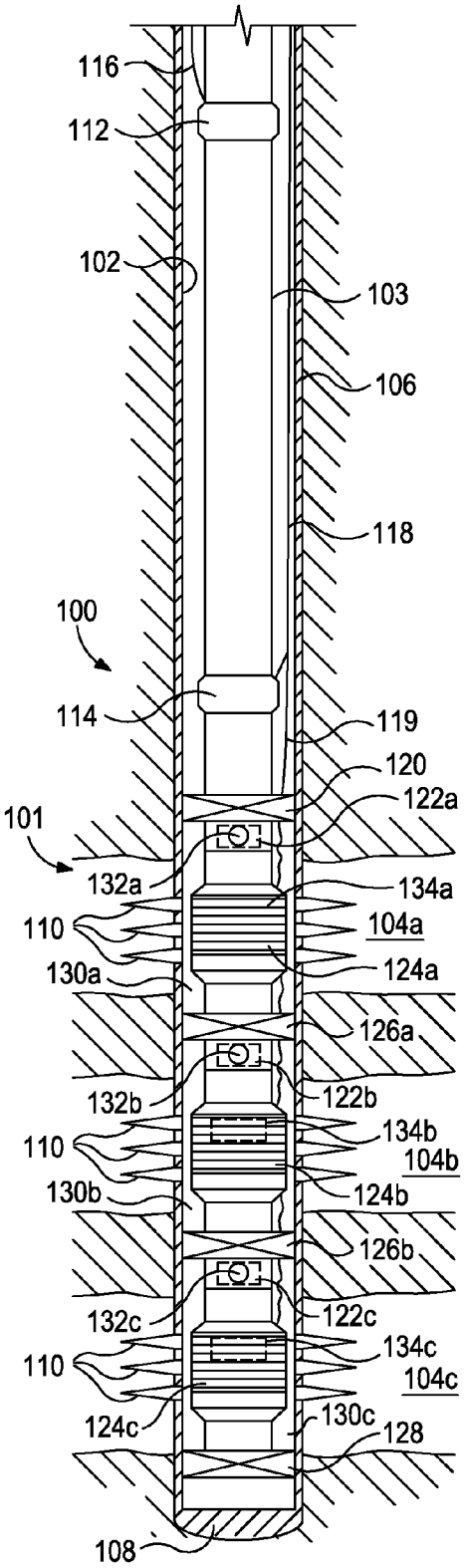
FIG. 1 is an exemplary single trip multi-zone system, according to one or more embodiments.

Referring to FIG. 1, illustrated is an exemplary single trip multi-zone completion system 100, according to one or more embodiments. As illustrated, the system 100 may include an outer completion string 101 coupled to a work string or production tubing 103 that extends longitudinally within a wellbore 102. The wellbore 102 may penetrate multiple formation zones 104*a*, 104*b*, and 104*c*, and the outer completion string 101 may be extended into the wellbore 102 until being arranged or otherwise disposed adjacent the formation zones 104*a-c*. The formation zones 104*a-c* may be portions of a common subterranean formation or hydrocarbon-bearing reservoir. Alternatively, one or more of the formation zones 104*a-c* may be portion(s) of separate subterranean formations or hydrocarbon-bearing reservoirs. The term "zone" as used herein, however, is not limited to one type of rock formation or type, but may include several types, without departing from the scope of the disclosure.

As will be discussed in greater detail below, the system 100 may be deployed within the wellbore 102 in a single trip and used to hydraulically fracture and gravel pack the various formation zones 104*a-c*, and subsequently regulate hydrocarbon production therefrom. Although only three formation zones 104*a-c* are depicted in FIG. 1, it will be appreciated that any number of formation zones 104*a-c* (including one) may be treated or otherwise serviced using the system 100, without departing from the scope of the disclosure.

As is depicted in FIG. 1, the wellbore 102 may be lined with a string of casing 106 and properly cemented therein, as known in the art. In at least one embodiment, a cement plug 108 may be formed at the bottom of the casing 106. In other embodiments, however, the system 100 may be deployed or otherwise operated in an open-hole section of the wellbore 102, without departing from the scope of the disclosure. One or more perforations 110 may be formed in the casing 106 at each formation zone 104*a-c* and configured to provide fluid communication between each respective formation zone 104*a-c* and the annulus formed between the outer completion string 101 and the casing 102.

The system 100 may include a safety valve 112 and a crossover coupling 114 arranged in or otherwise forming part of the production tubing 103. In some embodiments, the safety valve 112 may be a tubing-retrievable safety valve, such as the DEPTHSTAR® safety valve commercially-available from Halliburton Energy Services of Houston, Tex., USA. The safety valve 112 may be controlled using a control line 116 that extends from a remote location (not shown), such as the Earth's surface or another location within the wellbore 102, to the safety valve 112. In at least one embodiment, the control line 116 may be a surface-controlled subsurface safety valve control line that controls the actuation of the safety valve 112.

In some embodiments, the crossover coupling 114 may be an electro-hydraulic wet connect that provides an electrical wet mate connection between opposing male and female connectors. In other embodiments, the crossover coupling 114 may be an inductive coupler providing a releasable electromagnetic coupling or connection with no contact between the crossover coupling 114 and the internal tubing. Exemplary crossover couplings 220 that may be used in the disclosed system 100 are described in U.S. Pat. Nos. 8,082,998, 8,079,419, 4,806,928 and in U.S. patent application Ser. No. 13/405,269, each of which is hereby incorporated by reference in their entirety.

One or more control lines 118 may extend external to the production tubing 103 from a remote location (e.g., the Earth's surface or another location within the wellbore 102) to the crossover coupling 114. At the crossover coupling 114, portions of the control line 118 may be coupled to or otherwise extend within the crossover coupling 114 and be configured to communicably couple devices or mechanisms arranged within the outer completion string 101 to the surface, as will be described in greater detail below. Moreover, at least one length or portion of the control line 118, labeled as a surveillance line 119, may run past the crossover coupling 114, as illustrated, and extend externally along the outer surface of the outer completion string 101.

Although only one control line 118 and associated surveillance line 119 is shown in FIG. 1, it will be appreciated that any number of control lines 118 (and associated surveillance line(s) 119) may be used in the system 100, without departing from the scope of the disclosure. For example, the illustrated control line 118 may be representative of or otherwise include one or more hydraulic lines, one or more electrical lines, and/or one or more fiber optic lines that extend from the surface external to the production tubing 103 until reaching the crossover coupling 114. The hydraulic and electrical lines may be configured to provide power to various downhole equipment, but may also be configured to receive and convey command signals and otherwise transmit data to and from the surface of the well. The fiber optic lines, as will be discussed in more detail below, may be configured to monitor one or more fluid and/or well environment parameters, such as pressure, temperature, seismic waves (e.g., flow-induced vibrations), radioactivity, water cut, flow rate, etc.

The outer completion string 101 may have a top packer 120 including slips (not shown) configured to support the outer completion string 101 within the casing 106 when properly deployed. Disposed below the top packer 120 is a first flow control device 122*a* (shown in dashed) and a first sand screen 124*a*. A first isolation packer 126*a* is disposed below the first sand screen 124*a* and a second circulating sleeve 122*b* (shown in dashed) and a second sand screen 124*b* are disposed below the first isolation packer 126*a*. A second isolation packer 126*b* is disposed below the second sand screen 124*b* and a third circulating sleeve 122*c* (shown in dashed) and a third sand screen 124*c* are disposed below the second isolation packer 126*b*. The circulating sleeves 122*a-c* may be movably arranged within the outer completion string between open and closed positions. Although described herein as movable sleeves, those skilled in the art will readily recognize that each circulating sleeve 122*a-c* may be any type of flow control device, without departing from the scope of the disclosure.

A first annulus 130*a* may be defined between the first formation zone 104*a* and the outer completion string 101. Second and third annuli 130*b* and 130*c* may similarly be defined between the second and third formation zones 104*b* and 104*c*, respectively, and the outer completion string 101. First, second, and third ports 132*a*, 132*b*, and 132*c* may be defined in the outer completion string 101 at the first, second, and third circulating sleeves 122*a-c*, respectively. When the respective circulating sleeves 122*a-c* are moved into their open positions, the ports 132*a-c* become exposed and may provide fluid communication from the interior of the outer completion string 101 into the corresponding annuli 130*a-c*.

In some embodiments, a sump packer 128 may be disposed below the third sand screen 124*c* around a lower seal assembly (not shown). In at least one embodiment, the outer completion string 101 is lowered into the wellbore 102 until engaging the sump packer 128. In other embodiments, the outer completion string 101 may be lowered into the wellbore 102 and stung into the sump packer 128. In yet other embodiments, the sump packer 128 is omitted from the system 100 and the production tubing 103 may instead be blanked off at its bottom end so that there is no inadvertent production directly into the outer completion string 101 without first passing through at least the third sand screen 124*c*. In embodiments where the system 100 is deployed in an open hole section of the wellbore 102, suitable inflatable packers or expandable packers could be used in place of the sump packer 128, the top packer 120, and the isolation packers 122*a,b*.

In order to deploy the outer completion string 101 downhole, the sump packer 128 may be lowered into the wellbore 102 and set by wire line at a predetermined location below the various formation zones 104*a-c*. The outer completion string 101 is then assembled at the surface starting from the bottom up until the outer completion string 101 is completely assembled and suspended in the wellbore 102 up to a packer or slips (not shown) arranged at the surface. The outer completion string 101 may then be lowered into the wellbore 102 on the production tubing 103 (i.e., work string) which is generally made up to the top packer 120. In some embodiments, the crossover coupling 114 may be located approximate to the top packer 120, as illustrated. The safety valve 112 may be added approximate to the well head (not shown). Spacing on the production tubing 103 may be verified and the well head is then attached to the production tubing 103.

The outer completion string 101 may then be lowered into the wellbore 102 on the production tubing 103 until engaging the sump packer 128. Upon aligning the sand screens 124*a-c* with the corresponding production zones 104*a-c*, the top packer 120 may be set and serves to suspend the outer completion string 101 within the wellbore 102. The isolation packers 126*a,b* may also be set at this time, thereby axially defining each annulus 130*a-c*. The top packer 120, and the isolation packers 126*a,b*, may further include or otherwise be configured for control line bypass which allows the surveillance line 119 to pass therethrough external to the outer completion string 101.

At this point, an inner service tool (not shown), also known as a gravel pack service tool, may be assembled and lowered into the outer completion string 101 on a work string (not shown) made up of drill pipe or tubing. The inner service tool may include one or more shifting tools (not shown) used to open and close the circulating sleeves 122*a-c* and also open and close corresponding flow control devices 134*a*, 134*b*, and 134*c* (shown in dashed) movably arranged within each sand screen 124*a-c*. In some embodiments, the flow control device 134*a-c* may be a sliding sleeve, axially movable within its corresponding sand screen 124*a-c*. Accordingly, in at least one embodiment, the flow control devices 134*a-c* may be characterized as inflow control device.

As will be discussed in greater detail below, each flow control device 134*a-c* allows fluid communication from an adjacent formation zone 104*a-c* into the outer completion string 101 via its corresponding sand screen 124*a-c*. In some embodiments, the inner service tool has two shifting tools arranged thereon, one shifting tool configured to open the circulating sleeves 122*a-c* and the flow control devices 134*a-c*, and a second shifting tool configured to close the circulating sleeves 122*a-c* and the flow control devices 134*a-c*. In other embodiments, more or less than two shifting tools may be used, without departing from the scope of the disclosure.

Before producing hydrocarbons from the various formation zones 104*a-c*, each formation zone 104*a-c* may be hydraulically fractured in order to enhance hydrocarbon production, and each annulus 130*a-c* may be gravel packed to ensure limited sand production into the outer completion string 101 during production. The fracturing and gravel packing process for the outer completion string 101 may be accomplished in step-wise fashion for each individual formation zone 104*a-c*, starting from the bottom up. In one embodiment, for example, the third formation zone 104*c* may be fractured and the third annulus 130*c* may be gravel packed first. To accomplish this, the second isolation packer 126*b* is set, thereby effectively isolating the third annulus 130*c* from the first and second annuli 130*a,b*. The one or more shifting tools may then be used to open the third circulating sleeve 122*c* and the third flow control device 134*c* disposed within the third sand screen 124*c*.

A fracturing fluid may then be pumped down the work string and into the inner service tool. In some embodiments, the fracturing fluid may include a base fluid, a viscosifying agent, proppant particulates (including a gravel slurry), and one or more additives, as generally known in the art. The incoming fracturing fluid may be directed out of the outer completion string 101 and into the third annulus 130*c* via the third port 132*c*. Continued pumping of the fracturing fluid forces the fracturing fluid into the third formation zone 104*c*, thereby creating or enhancing a fracture network therein while the accompanying proppant serves to support the fracture network in an open configuration. The incoming gravel slurry builds in the annulus 130*c* between the sump packer 128 and the second isolation packer 126*b* and forms what is known as a "sand face." The sand face, in conjunction with the third sand screen 124*c*, serves to prevent the influx of sand or other particulates from the third formation zone 104*c* into the outer completion string 101 during production operations.

Once a desired net pressure is built up in the third formation zone 104*c*, the fracturing fluid injection rate is slowed or stopped altogether, and a return flow of fracturing fluid flows through the third sand screen 124*c* and flow control device 134*c* and back into the outer completion string 101 in order to reverse out any excess proppant that may remain in the outer completion string 101. When the proppant is successfully reversed, the third circulating sleeve 122*c* and the third flow control device 134*c* are closed using the one or more shifting tools, and the third annulus 130*c* is then pressure tested to verify that the sleeves 122*c*, 134*c* are properly closed. At this point, the third formation zone 104*c* has been successfully fractured and the third annulus 130*c* has been gravel packed.

The inner service tool may then be moved within the outer completion string 101 to locate the second formation zone 104*b* and first formation zone 104*a*, successively, where the foregoing process is repeated in order to fracture the first and second formation zones 104*a,b* and gravel pack the first and second annuli 130*a,b*. To accomplish this, the first isolation packer 126*a* is set to isolate the second annulus 130*b* from the first annulus 130*a*, and the one or more shifting tools are then used to open the second circulating sleeve 122*b* and the second flow control device 134*b*. Fracturing fluid may then be pumped into the second annulus 130*b* via the second port 132*b*. The injected fracturing fluid fractures the second formation zone 104*b*, and the gravel slurry builds another sand face in the second annulus 130*b* between the second isolation packer 126*b* and the first isolation packer 126*a*. Once the second annulus 130*b* is pressure tested, the inner service tool may then be moved to locate the first formation zone 104*a* and again repeat the process. The one or more shifting tools are used to open the first circulating sleeve 122*a* and the first flow control device 134*a*. Fracturing fluid may then be pumped into the first annulus 130*a* via the first port 132*a*. The injected fracturing fluid fractures the first formation zone 104*a*, and the gravel slurry builds yet another sand face in the first annulus 130*a* between the first isolation packer 126*a* and the top packer 120. Once the first annulus 130*a* is pressure tested, the inner service tool (i.e., the gravel pack service tool) may be removed from the outer completion string 101 and the well altogether, with the circulation sleeves 122*a-c* and flow control devices 134*a-c* providing isolation during installation of the remainder of the completion, as discussed below.

Figure 2:
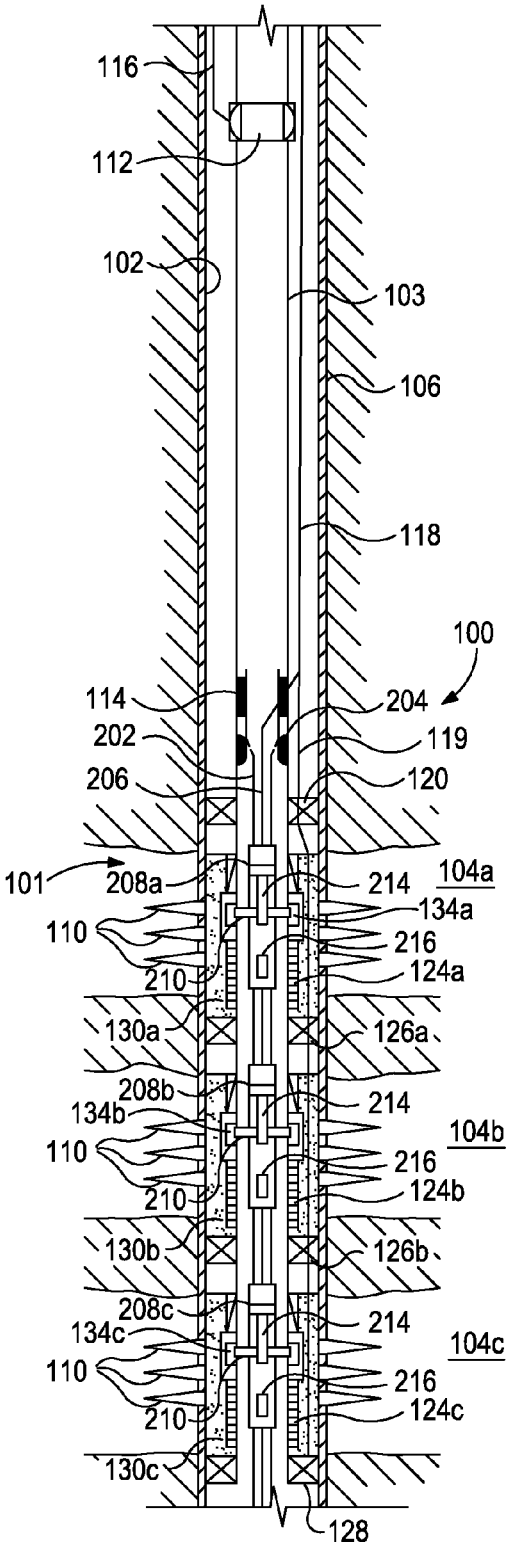
FIG. 2 is a partial cross-sectional view of the single trip multi-zone system of FIG. 1, having an exemplary insert string arranged therein, according to one or more embodiments disclosed.

Referring now to FIG. 2, with continued reference to FIG. 1, illustrated is a partial cross-sectional view of the single trip multi-zone system 100 having an exemplary insert string 202 arranged therein, according to one or more embodiments. The insert string 202 may be run or otherwise conveyed through the production tubing 103 until landing off at an anchor profile 204 provided in the outer completion string 101 or production tubing 103. As illustrated, the anchor profile 204 may be arranged downhole from the crossover coupling 114 and may be configured to anchor the insert string 202 such that the insert string 202 is secured or otherwise "hung off" at this point. In other embodiments, however, the anchor profile 204 may be arranged above or uphole from the crossover coupling 114, without departing from the scope of the disclosure.

The insert string 202 may be communicably coupled to the system 100, or otherwise the outer completion string 101, at the crossover coupling 114. As illustrated, the insert string 202 may include an integrated umbilical 206 that extends longitudinally therein and conveys one or more hydraulic, electrical, and/or fiber optic lines to devices or mechanisms arranged within the insert string 202. Upon appropriately anchoring the insert string 202, the crossover coupling 114 may be configured to provide either an electro-hydraulic wet mate connection or an electromagnetic induction connection between the integrated umbilical 206 and the control line 118. As a result, the control line 118 may be communicably coupled to the integrated umbilical 206 such that the control line 118 is, in effect, extended into the interior of the insert string 202 in the form of the integrated umbilical 206.

The insert string 202 may be run into the wellbore 102 using any type of suitable conveyance mechanism (not shown) such as, but not limited to, work string, drill string, production tubing, coiled tubing, wire line, or the like. Once the insert string 202 is suitably hung off the anchor profile 204 and communicably coupled to the system 100 at the crossover coupling 114, the conveyance mechanism may be detached therefrom and removed from the well.

The insert string 202 may also include one or more control and data acquisition modules 208 (three shown as 208*a*, 208*b*, and 208*c*) axially spaced along the insert string 202. Each control and data acquisition module 208*a-c* may be spaced or otherwise arranged at or adjacent a corresponding formation zone 104*a-c* and configured to interact with the flow control device 134*a-c* of a corresponding sand screen 124*a-c*. For example, the first control and data acquisition module 208*a* may be arranged adjacent the first formation zone 104*a* and sand screen 124*a*, the second control and data acquisition module 208*b* may be arranged adjacent the second formation zone 104*b* and sand screen 124*b*, and the third control and data acquisition module 208*c* may be arranged adjacent the third formation zone 104*c* and sand screen 124*c*.

Each gauge control and data acquisition module 208*a-c* may also include one or more mechanical coupling mechanisms 210 (two shown on each control and data acquisition module 208*a-c*) configured to locate and manipulate the axial position of a corresponding flow control device 134*a-c*, thereby moving the flow control device 134*a-c* between open and closed positions. In one embodiment, the mechanical coupling mechanisms 210 may be actuatable arms. For instance, the mechanism(s) 210 of the first control and data acquisition module 208*a* may be configured to engage and move the first flow control device 134*a* arranged within the first sand screen 124*a*, the mechanism(s) 210 of the second control and data acquisition module 208*b* may be configured to engage and move the second flow control device 134*b* arranged within the second sand screen 124*b*, and the mechanism(s) 210 of the third control and data acquisition module 208*c* may be configured to engage and move the third flow control device 134*c* arranged within the third sand screen 124*c*. Moving the flow control devices 134*a-c* into an open position provides fluid communication from the formation zones 104*a-c* into the outer completion string 101 via the corresponding sand screens 124*a-c*. In some embodiments, each flow control device 134*a-c* may form part of an integrated mechanical interval control valve configured to exhibit variable flow capability. For example, adjusting the position of each flow control device 134*a-c* with a corresponding control and data acquisition module 208*a-c* may serve to choke or otherwise regulate the production flow rate through each sand screen 124*a-c*.

In order to accurately locate the flow control devices 134*a-c*, the mechanisms 210 (e.g., actuatable arms) of each gauge control and data acquisition module 208*a-c* may be actuatable. As illustrated, the integrated umbilical 206 may extend to each gauge control and data acquisition module 208*a-c*, thereby conveying one or more hydraulic, electrical, and/or fiber optic control lines to each gauge control and data acquisition module 208*a-c*, as initially conveyed from the surface via the control line 118. Accordingly, each gauge control and data acquisition module 208*a-c* may be powered hydraulically or electrically in order to actuate the mechanisms 210 and provide the necessary shifting force to open or close the flow control devices 134*a-c*.

In some embodiments, the mechanisms 210 may be electro-hydraulically actuated. In other embodiments, however, the mechanisms 210 may be actuated or moved via any suitable method including, but not limited to, mechanically, hydraulically, electromechanically, and the like. In some embodiments, the mechanisms 210 may be actuatable in an axial direction along an actuator body 214 arranged within each gauge control and data acquisition module 208*a-c*. For instance, the mechanisms 210 may be configured to translate up and down the body 214 of a corresponding control and data acquisition module 208*a-c* until properly locating the corresponding flow control device 134*a-c*. In other embodiments, the mechanisms 210 may be actuatable radially and configured to extend and contract radially with respect to the gauge control and data acquisition module 208*a-c*. In yet other embodiments, the mechanisms 210 may be pivotably coupled to the body 214 such that the mechanisms 210 are rotatably actuatable in order to locate and engage a corresponding flow control device 134*a-c*. In even further embodiments, the mechanisms 210 may actuatable in any combination of two or more of the preceding actuation formats described above, without departing from the scope of the disclosure.

Once the mechanisms 210 of each gauge control and data acquisition module 208*a-c* find their corresponding flow control device 134*a-c*, the mechanisms 210 may be configured to axially move the flow control devices 134*a-c* between open and closed positions. Electronics associated with each control and data acquisition module 208*a-c* may be configured to measure and report to the surface how far each flow control device 134*a-c* has been opened. Accordingly, the position of each flow control device 134*a-c* may be known and adjusted in real-time in order to choke or otherwise regulate the production flow rate through each corresponding sand screen 124*a-c*. In some embodiments, it may be desired to open one or more of the flow control devices 134*a-c* only partially (e.g., 20%, 40%, 60%, etc.) in order to choke production flow from one or more formation zones 104*a-c*. At a later time, it may be desired to adjust the position of the flow control device 134*a-c* again either to a more open or more closed position.

As the flow control device 134*a-c* is moved from its closed position into an open position (either fully or partially open), a corresponding port (not shown) defined in the outer completion string 101 is uncovered or otherwise exposed, thereby allowing the influx of fluids into the outer completion string 101 from the respective formation zone 104*a-c*. In some embodiments, the port may have an elongated or progressively enlarged shape in the axial direction required to move the flow control device 134*a-c* from closed to open positions. As a result, as the corresponding flow control device 134*a-c* translates to its open position, the volumetric flow rate through the port may progressively increase proportional to its progressively enlarged shape. In some embodiments, for example, one or more of the ports may exhibit an elongated triangular shape which progressively allows an increased amount of fluid flow as the corresponding flow control device 134*a-c* moves to its open position. In other embodiments, however, one or more of the ports may exhibit a tear drop shape, and achieve substantially the same fluid flow increase as the flow control device 134*a-c* moves axially. Accordingly, each flow control device 134*a-c* may be characterized as an integrated flow control choke device.

In other embodiments, however, one or more of the flow control devices 134*a-c* may be autonomous variable flow restrictors. For instance, at least one of the flow control devices 134*a-c* may include a spring actuated movable sleeve that opens and closes autonomously, depending on the pressure experienced within each production interval. This may prove advantageous in equalizing fluid flow across multiple production intervals. Other exemplary autonomous variable flow restrictors that may be appropriate for the disclosed embodiments are described in U.S. Pat. No. 8,235,128, incorporated herein by reference in its entirety.

The control and data acquisition modules 208*a-c* may also include one or more gauges or sensors 216 arranged thereon and communicably coupled to the integrated umbilical 206. In particular, the sensors 216 may be communicably coupled to one or more fiber optic and/or electrical lines forming part of the integrated umbilical 206 and configured to detect or otherwise measure one or more fluid and/or well environment parameters such as, but not limited to, pressure, temperature, flow rate, seismic waves (e.g., flow-induced vibrations), radioactivity, combinations thereof, and the like.

The sensors 216 arranged inside the outer completion string 101 may work in conjunction with the sensing capabilities provided by the surveillance line 119 disposed outside the outer completion string 101 and extending along the sand face. The surveillance line 119 may include, for example, a fiber optic line and one or more accompanying fiber optic gauges or sensors (not shown). The fiber optic line may be deployed along the sand face and the associated gauges/sensors may be configured to measure and report various fluid properties and well environment parameters within each gravel packed annulus 130*a-c*. For instance, the fiber optic line may be configured to measure pressure, temperature, fluid density, seismic activity, vibration, compaction, combinations thereof, and the like. In some embodiments, the fiber optic line may be configured to measure temperature along the entire axial length of each sand screen 124*a-c* and measure fluid pressure in discrete or predetermined locations within the sand face.

The surveillance line 119 may further include an electrical line coupled to one or more electric pressure and temperature gauges/sensors situated along the outside of the outer completion string 101. Such gauges/sensors may be arranged adjacent to each sand screen 124*a-c*, for example, in discrete locations on one or more gauge mandrels (not shown). In operation, the electrical line may be configured to measure fluid properties and well environment parameters within each gravel packed annulus 130*a-c* or radially adjacent to where the insert string 202 is located. Such fluid properties and well environment parameters include, but are not limited to, pressure, temperature, fluid density, vibration, radioactivity, combinations thereof, and the like. In some embodiments, the electronic gauges/sensors can be ported to the inner diameter of each sand screen 124*a-c*.

Accordingly, the fiber optic and electrical lines of the surveillance line 119 may provide an operator with two sets of monitoring data for the same or similar location within the sand face or production intervals. In operation, the electric and fiber optical gauges may be redundant until one technology fails or otherwise malfunctions. As will be appreciated by those skilled in the art, using both types of measurement provides a more robust monitoring system against failures. Moreover, this redundancy may aid in accurately diagnosing problems with the wellbore equipment, such as the gauge mandrels 208*a-c*, the flow control devices 134*a-c*, etc. In other embodiments, the surveillance line 119 may also include a hydraulic line configured to provide a conduit for deploying additional fiber optic fibers or electrical lines.

Those skilled in the art will readily recognize the several advantages afforded by instrumenting the wellbore 102 both external and internal to the outer completion string 101. For example, the flow of the fracturing fluid injected into each formation zone 104*a-c* may be monitored by the surveillance line 119, thereby determining where it is located. This may be determined by temperature changes in the fluids within the annuli 130*a-c*, as measured by one or more distributed temperature sensors (not shown) associated with the surveillance line 119. In other embodiments, the sensors and/or gauges associated with the surveillance line 119 may also be configured to monitor each annulus 130*a-c* for water break through or zonal depletion.

The monitoring capabilities provided by the surveillance line 119 may be used in conjunction with the sensors 216 arranged inside the outer completion string 101. For example, the sensors 216 and the various sensors/gauges associated with the surveillance line 119 may be configured to monitor pressure and temperature differentials between the sand face and the interior of the outer completion string 101. Such data may allow an operator to determine areas along the wellbore 102 where collapse or water break through has occurred, or when a formation zone 104*a-c* may be nearing zonal depletion. Pressure drops may be measured and reported through the gravel pack of each annulus 130*a-c* and/or through the filtration of each sand screen 124*a-c*. The pressure drop, for instance, may be monitored long term to determine or map any significant changes. An increased pressure drop may be indicative of a general decline in production, thereby allowing the operator to proactively treat the formation zone(s) 104*a-c* via, for example, an acid treatment or other simulation configured to improve production rates.

In some embodiments, the flow path of production fluids through the sand screens 124*a-c* to the respective flow control device 134*a-c* (i.e., flow control device) may be traced by monitoring the pressure and/or temperature external and internal to the outer completion string 101. To accomplish this, the production from a particular formation zone 104*a-c* may be shut off, then slowly restarted. Monitoring the gauges associated with the surveillance line 119 and the sensors 216 arranged inside the outer completion string 101 may be useful in demonstrating the flow path through the gravel pack of each annulus 130*a-c*.

Isolating and measuring fluid properties from each formation zone 104*a-c* may also reveal fluid flow between adjacent zones 104*a-c* and leak detection in various equipment associated with the system 100. If a leak is detected, diagnostics can be run to determine exactly where the leak is occurring.

As will be appreciated, such measurements may prove highly advantageous in intelligently producing the hydrocarbons from each formation zone 104*a-c*. For instance, by knowing production rates and other environmental parameters associated with each formation zone 104*a-c*, an operator may be able to adjust fluid flow rates through each sand screen 124*a-c* using the respective control and data acquisition modules 208*a-c*. As a result, the formation zones 104*a-c* may be more efficiently produced, in order to maximize production and save time. Moreover, by continually monitoring the environmental parameters of each formation zone 104*a-c*, the operator may be able to determine when a problem has resulted, such as formation collapse, water break through, or zonal depletion, thereby being able to proactively manage production and save costs.

Another significant advantage provided by the system 100 is the ability to disconnect the insert string 202 from the outer completion string 101 and retrieve it to the surface without having to remove the outer completion string 101 from the wellbore 102. For instance, in the event a portion of the insert string 202 fails, such as a gauge control and data acquisition module 208*a-c* or associated sensor 216, the conveyance mechanism used to initially run the insert string 202 into the wellbore 102 can once again be attached to the insert string 202 and pull it back to the surface. Once at the surface, the failed or faulty devices located on the insert string 202 may be rebuilt, replaced, or upgraded. In other cases, the problems associated with the insert string 202 may be investigated such that improvements to the insert string 202 may be undertaken. The repaired or upgraded insert string 202 may then be reintroduced into the wellbore 102 and communicably coupled once again to the system 100 at the crossover coupling 114, as generally described above. In the interim, the circulating sleeves and flow control devices 122*a-c*, 134*a-c* may be closed, thereby preventing inadvertent flow into the production tubular 103.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present invention. The invention illustratively disclosed herein suitably may be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

The invention claimed is:

1. A method of producing from one or more formation zones, comprising:

arranging an outer completion string within a wellbore adjacent the one or more formation zones, the outer completion string having at least one sand screen arranged thereabout and a flow control device movably disposed within the at least one sand screen;

coupling the outer completion string to a production tubing;

locating an insert string within the outer completion string, the insert string having at least one control and data acquisition module disposed thereon and the at least one control and data acquisition module having one or more mechanical coupling mechanisms;

wherein locating the insert string within the outer completion string further comprises communicably coupling the insert string to the outer completion string at a crossover coupling, the crossover coupling having one or more control lines coupled thereto;

wherein the one or more control lines extend external to the production tubing from a remote location to the crossover coupling;

extending a portion of the one or more control lines past the crossover coupling as a surveillance line, wherein the surveillance line extends externally along the outer surface of the outer completion string;

locating the flow control device with the one or more mechanical coupling mechanisms; and moving the flow control device between a closed position and an open position with the one or more mechanical coupling mechanisms, wherein, when in the open position, fluids may communicate from the one or more formation zones, through the at least one sand screen, and into the outer completion string.

2. The method of claim 1, further comprising actuating the one or more mechanical coupling mechanisms in order to locate and move the flow control device.

3. The method of claim 1, further comprising varying a position of the flow control device in order to choke a fluid flow therethrough.

4. The method of claim 1, wherein moving the flow control device between the closed position and the open position further comprises:

moving the flow control device partially between the closed and open positions; and choking a fluid flow through the at least one sand screen.

5. The method of claim 1, further comprising:

detaching the insert string from the outer completion string;

retrieving the insert string to a well surface while the outer completion string remains within the wellbore adjacent the one or more formation zones;

re-locating the insert string within the outer completion string; and communicably coupling the insert string to the outer completion string at the crossover coupling.

6. A method of deploying a single trip multi-zone completion system, comprising:

arranging an outer completion string within a wellbore that penetrates one or more formation zones, the outer completion string having at least one sand screen arranged thereabout and a flow control device movably disposed within the at least one sand screen;

coupling the outer completion string to a production tubing;

locating an inner service tool within the outer completion string;

treating the one or more formation zones with the inner service tool;

retrieving the inner service tool from within the outer completion string;

locating an insert string within the outer completion string, the insert string having at least one control and data acquisition module arranged therein;

wherein locating the insert string within the outer completion string further comprises communicably coupling the insert string to the outer completion string at a crossover coupling, the crossover coupling having one or more control lines coupled thereto;

wherein the one or more control lines extend external to the production tubing from a remote location to the crossover coupling;

extending a portion of the one or more control lines past the crossover coupling as a surveillance line, wherein the surveillance line extends externally along the outer surface of the outer completion string; and locating and moving the flow control device with the at least one control and data acquisition module and thereby regulating a fluid flow through the at least one sand screen.

7. The method of claim 6, wherein locating and moving the flow control device with the at least one control and data acquisition module further comprises locating the flow control device with one or more mechanical coupling mechanisms extending from the at least one control and data acquisition module.

8. The method of claim 6, further comprising moving the flow control device between a closed position and an open position with the at least one control and data acquisition module, wherein, when in the open position, fluids may communicate from the one or more formation zones, through the at least one sand screen, and into the outer completion string.

9. The method of claim 8, further comprising:

moving the flow control device partially between the closed and open positions; and choking the fluid flow through the at least one sand screen.

10. The method of claim 6, further comprising varying a position of the flow control device in order to choke a fluid flow therethrough.

11. The method of claim 6, wherein treating the one or more formation zones comprises hydraulically fracturing and gravel packing the one or more formation zones.

* * * * *